United States Patent [19]

Norbäch

[11] 4,296,780

[45] Oct. 27, 1981

[54] APPARATUS INCLUDING THROTTLING DEVICE FOR USE IN VENTILATION DUCT

[75] Inventor: Per Norbäch, Askrikevagen, Sweden

[73] Assignee: A. B. Carl Munters, Sollentuna, Sweden

[21] Appl. No.: 125,442

[22] Filed: Feb. 28, 1980

Related U.S. Application Data

[63] Continuation-in-part of Ser. No. 50,519, Jun. 21, 1979, abandoned.

[30] Foreign Application Priority Data

Jun. 21, 1978 [SE] Sweden ..... 7807129
Dec. 13, 1979 [NO] Norway ..... 794084

[51] Int. Cl.[3] ..... F15D 1/02

[52] U.S. Cl. ..... 138/40; 55/293; 55/294; 55/303; 55/404; 165/5; 165/95; 98/40 R; 138/41

[58] Field of Search ..... 55/120, 132, 293, 294, 55/298, 303, 309, 404, 290, 302, 521; 165/5, 95; 210/355, 411; 98/40 R; 138/40, 41; 15/352

[56] References Cited

U.S. PATENT DOCUMENTS

| | | | |
|---|---|---|---|
| 2,216,986 | 10/1940 | Roe | 55/302 |
| 2,601,704 | 7/1952 | Streun | 55/302 |
| 2,795,291 | 6/1957 | Pierce | 55/293 |
| 3,002,585 | 10/1961 | Pasturczak | 55/290 |
| 3,447,290 | 6/1969 | Flory | 55/404 |
| 3,624,161 | 11/1971 | Bub | 55/521 |
| 3,780,767 | 12/1973 | Borg et al. | 138/42 |
| 3,837,149 | 9/1974 | West et al. | 55/290 |
| 3,951,627 | 4/1976 | Barr, Jr. et al. | 55/293 |

FOREIGN PATENT DOCUMENTS

| | | | |
|---|---|---|---|
| 705269 | 3/1965 | Canada | 165/95 |
| 1063015 | 8/1959 | Fed. Rep. of Germany | 55/294 |
| 2725190 | 12/1977 | Fed. Rep. of Germany | 55/131 |

*Primary Examiner*—David L. Lacey
*Attorney, Agent, or Firm*—Curtis, Morris & Safford

[57] ABSTRACT

An air jet cleaning apparatus for use with throttling devices mounted in ventilation ducts in which the throttling device includes a body having opposite air inlet and outlet sides and a plurality of fine through passages for conveying air flowing from the inlet to the outlet sides thereof. The apparatus includes a deflector shield mounted adjacent the inlet side of the body to allow for relative movement between the deflector and the body. The shield has an opening facing the inlet side of the body which is caused to sweep over the inlet side during relative movement between the shield and body. A duct provides communication between the shield and the outlet side of the throttling device whereby the drop of pressure across the throttling device diverts a partial air flow through the shield in another direction than the main air flow into the body of the throttling device in order to clean the surface of the inlet side of the body.

12 Claims, 6 Drawing Figures

APPARATUS INCLUDING THROTTLING DEVICE FOR USE IN VENTILATION DUCT

This application is a continuation-in-part of U.S. patent application Ser. No. 050,519 filed June 21, 1979, now abandoned.

The present invention relates to an apparatus for use in throttling devices for ventilation ducts.

Throttling devices used in ventilation ducts for admitted or supply air typically include an element having a number of through passages commonly mounted to cover almost the entire cross-sectional area of the ventilation duct, with the passages passing air from the inlet to the outlet side of the throttling device. Such throttling devices are designed for mounting in the air ducts of ventilation systems in order to ensure that the distribution of air within the system is as desired and to bring about a fall in pressure such that the spreading of flue gases, etc., from one room to another will be made more difficult in case of fire, while at the same time avoiding irritating noise.

An object of the present invention is to prevent the throttling member from becoming clogged or choked by deposits of dust and other solid particles.

Another object of the invention is to provide a means for cleaning the throttling member at its inlet, which is the site at which such deposits are likely to occur.

A further object of the invention is to provide a device of the character described which is both simple and inexpensive in manufacture and operation, and which functions reliably and efficiently.

The above, and other objects, features and advantages of the present invention will be apparent in the following detailed discription of illustrative embodiments thereof when read in connection with the accompanying drawings, wherein.

Figure 2:
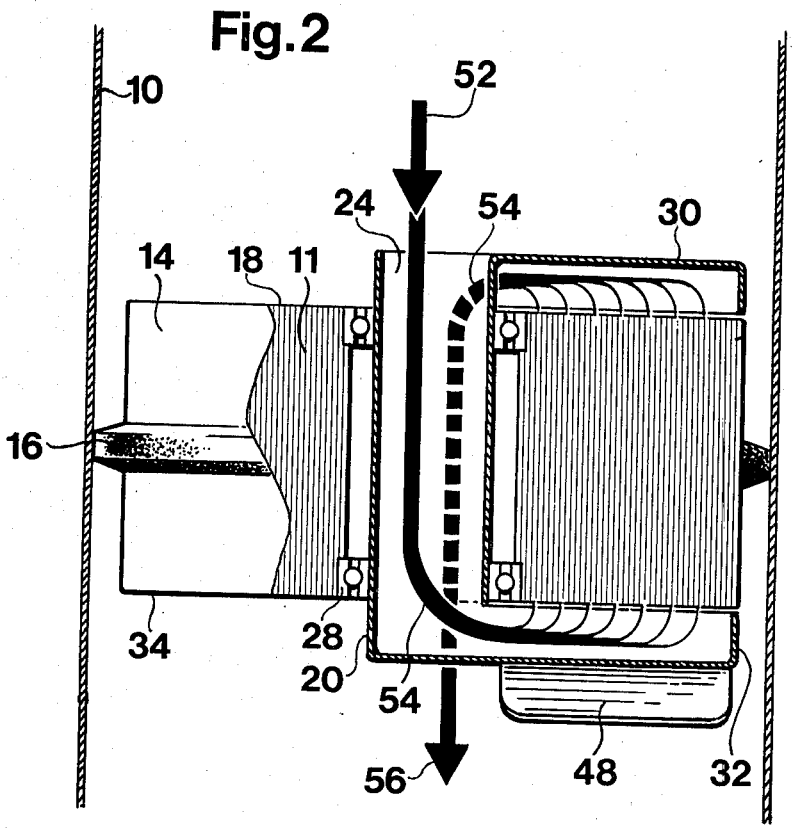
FIG. 2 is an elevational view, partly in section, of the device illustrated in FIG. 1.
Figure 5A:
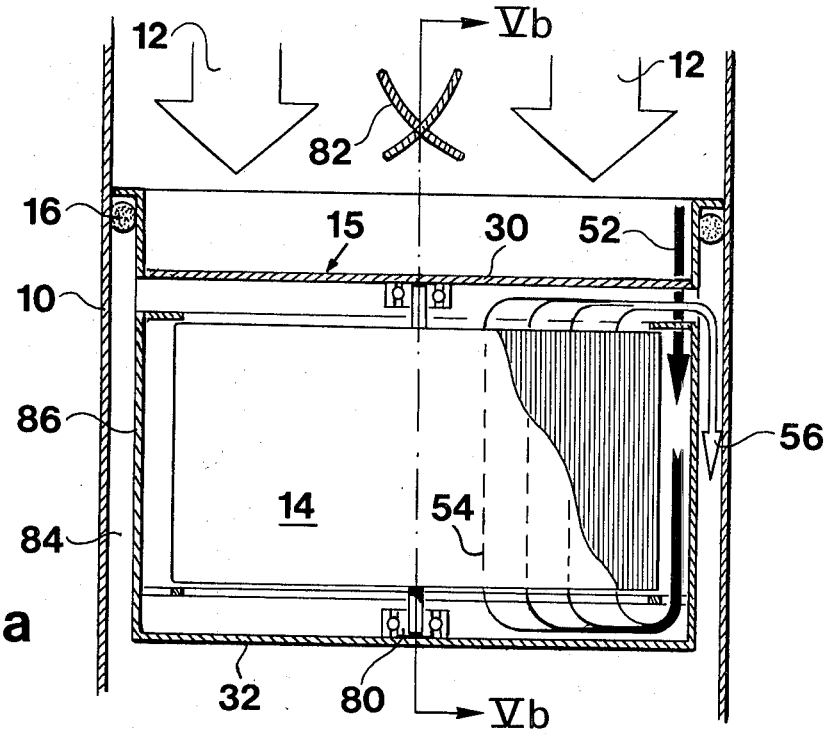
Figure 5B:
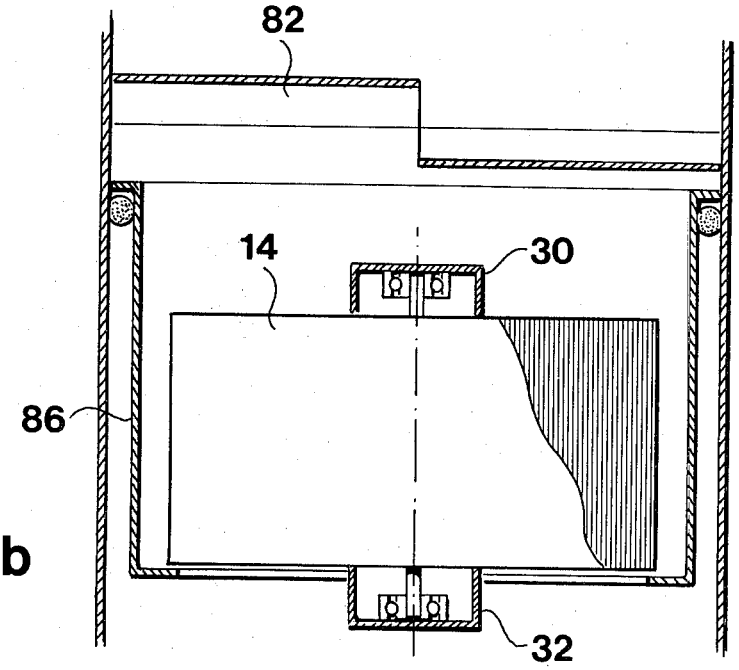

FIG. 5*a* is a cross-sectional view, similar to FIG. 2 of yet another embodiment of the invention; and FIG. 5*b* is a sectional view taken along line Vb- Vb of FIG. 5*a*.

Figure 1:
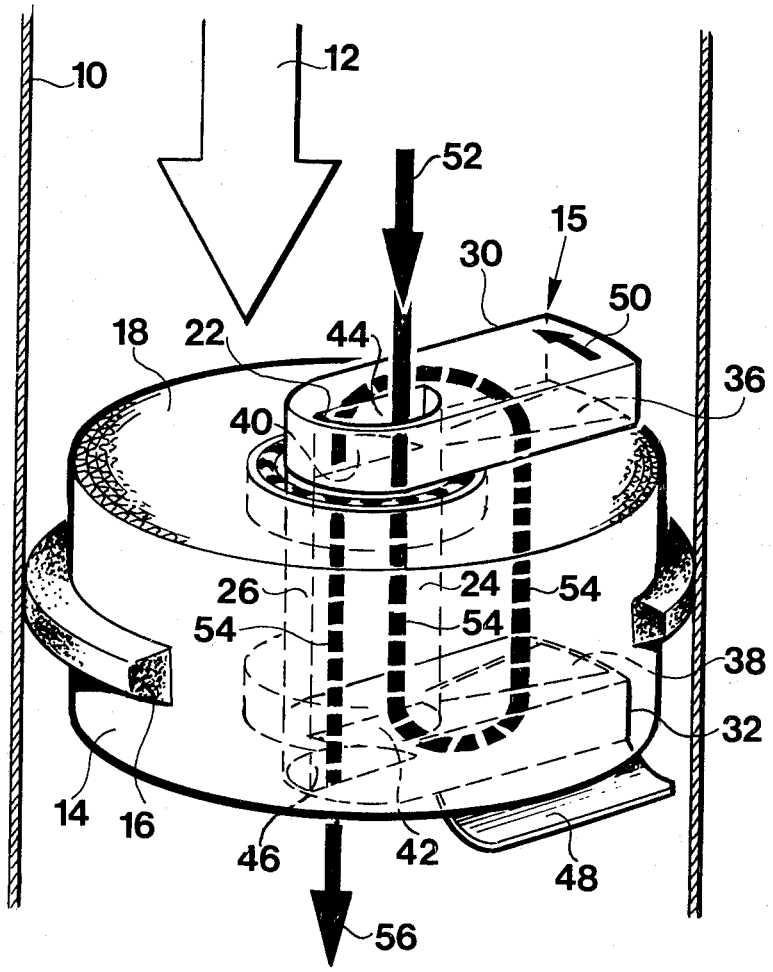
FIG. 1 is a perspective view of a throttling device provided with an air-jet cleaning device constructed in accordance with the present invention.
Figure 4:
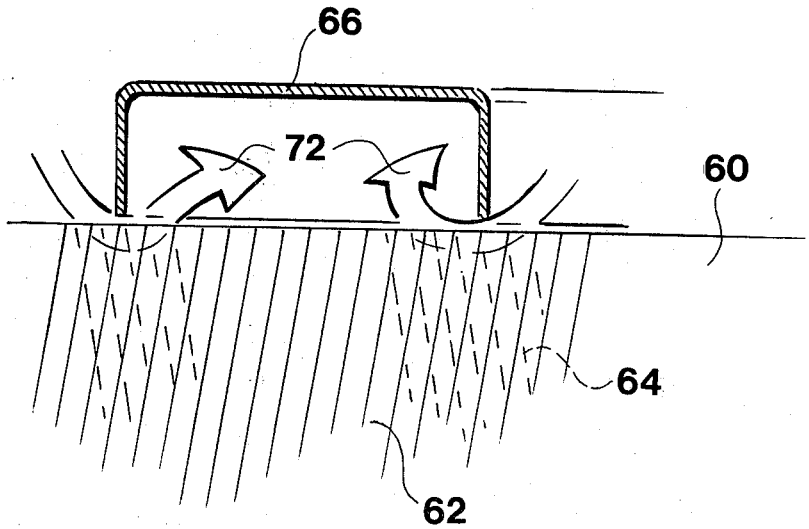
FIG. 4 is a partial cross-sectional view through the air-jet cleaning device and part of the throttling device of FIG. 3.
Figure 3:
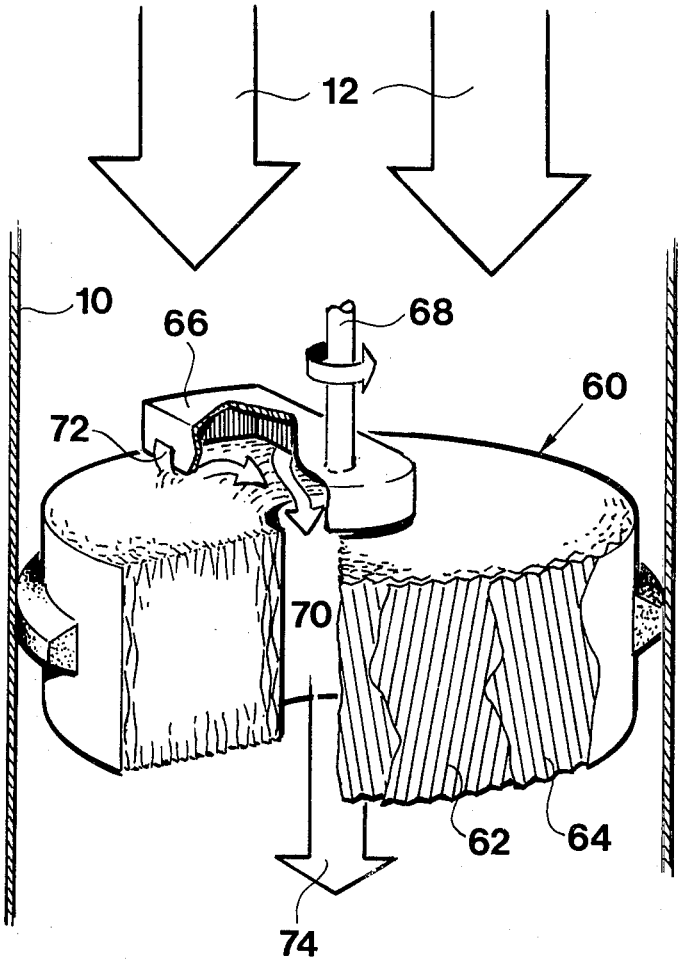
FIG. 3 is a perspective view, similar to FIG. 1, of another embodiment of a throttling device according to the invention.

Referring now to the drawing in detail, FIG. 1 illustrates the peripheral wall 10 of a cylindrical duct for supply air incorporated in a ventilation system into which air is introduced by means of a pressure fan (not shown) and flows in the direction indicated by arrow 12. Air conveyed through duct 10 is blown into a room by means of, for example, a discharger as described in greater detail in the U.S. Pat. No. 3,714,884. A throttling member 14 is mounted in duct 10 and has a number of through passages 11 formed therein running in a longitudinal direction parallel to the duct. The passages may be straight, parallel passages, as shown in FIG. 2 or passages of the type which in adjacent sheets cross each other at an angle, as shown in FIGS. 3 and 4. A ring-type seal or gasket 16 is used to form a seal between throttling member 14 and wall 10 of the duct.

In use there is a tendency for dust and other solid particles to be deposited on the upper surface of throttling member 14, this tendency being more or less depending on the design of the throttling member itself. For the purpose of continuously removing these particles as they are deposited, the invention provides an air-jet cleaning device 15 mounted in conjuction with the throttling member. This device comprises a tubular shaft 20 (FIG. 2) mounted centrally in throttling member 14 and divided by a partition 22 (FIG. 1) into two semicircular halves which define two ducts 24, 26. Shaft 20 is preferably mounted on ball bearings 28 or by some other means allowing the shaft to rotate freely in throttling member 14. The bearing of shaft 20 may of course also be located outside the throttling member, as shown and described below in connection with the embodiment of FIG. 3.

At each end of the shaft 20, the two ducts 24, 26 project beyond the surface of the throttling member and support a closed, box-shaped shield or arm 30, 32 against the inlet and outlet faces of the throttling member. These arms are essentially identical and are located opposite each other on the upper and lower surfaces 18, 34 respectively, of the throttling member 14. On the sides of the arms facing the adjacent face of the throttling member a sector-shaped opening 36, 38 is formed extending across the radius of the circular throttling member. Each arm 30, 32 is also provided with an opening 40, 42 respectively, corresponding in shape to the outline of the semicircular ducts 24, 26 of the shaft on the side of the arm facing the throttling member. Similar openings 44, 46, respectively, are formed on that side of the arms facing away from the throttling device. The circumferential edges of each opening 40, 42, 44 and 46 are sealed snugly against their equivalent half of the ducts 24, 26. The arms are thus supported by shaft 20; and each duct 24, 26 of the shaft leads both into the interior of one arm 30, 32 and to the exterior surface of the other arm.

At least one of the arms 30, 32 (in the example discussed here, the lower 32) is provided with a vane 48 so mounted as to be struck by the air streaming through duct 10 and throttling member 14. Vane 48 therefore serves to keep the air-jet cleaning device in rotation, thus causing arms 30, 32 to sweep continuously over the surfaces of throttling member 14 as indicated by arrow 50 at the top of FIG. 1. Although the greater part of the supply air 12 passes through the ducts or passages of throttling member 14 in the normal fashion, part of the air will flow through opening 44 in upper arm 30 as indicated by arrow 52. The flow of air so diverted then flows through duct 24 in shaft 20 to the opening 42 of the lower box-shaped arm or shield 32 and passes into the interior of arm 32. In the arm the air changes direction and flows upwards through the sector-shaped opening 38. The cleansing air jet thus produced passes back through the passages of throttling member 14 into the sector-shaped opening 36 in upper arm or shield 30. By this means any dust or similar deposit is removed from upper surface 18 of the throttling member at the place covered by the sector-shaped opening 36 in arm 30, which is at a position equivalent to the corresponding opening 38 of lower arm 32. The air jet and the particles it has removed are then diverted through arm 30 to the other semicircular duct 26 of tubular shaft 20. Finally, the cleansing air jet and the particles it has removed are led via duct 26 to the exterior of lower arm 22 and ejected through opening 46 into the main duct 10 on the outlet side of the throttling member 14 as indicated by arrow 56. The path taken by the air jet between the inlet 44 and the outlet 46 is shown in FIG. 1 by the broken line 54.

A characteristic feature of throttling members of the type described above having numerous through channels or passages, and one that is essential to their function, is that they are able to create large drops in pressure without giving rise to irritating noise. It should also be observed that this feature, essential as far as noise is concerned, is also retained by the air jet, which also passes through the fine channels or passages of the throttling device, albeit in the opposite direction.

Another embodiment of the present invention is illustrated in FIGS. 3 and 4. As seen therein, throttling device 60 is located in a ventilation duct 10 and comprises a body of wound corrugated sheets which are in contact with each other and in which adjacent sheets have corrugations 62, 64 crossing each other at a small angle so that the corrugations in the finished body form inclined passages for the flow of air through the body. The throttling device 60 operates in the same manner as that described in connection with the embodiment of FIGS. 1 and 2 with regard to the throttling function; that is, air entering the duct, as indicated by arrows 12, is subject to a drop in pressure when passing through the throttling device.

The partial penetration of the cleansing air into the passages which is illustrated in FIG. 4 and which is possible due to the fact that the fine passages communicate in a direction perpendicular to the radius of the throttling device can naturally also be accomplished in a throttling device structure comprising only parallel sheets or in a corrugated structure with extended corrugations.

The embodiments ilustrated and described above are simply illustrative of one way of realizing the invention, which may be varied or modified while still remaining within the framework of the basic idea. Thus, although these embodiments have been described as being driven by the flow of air, the air-jet cleaning devices 30, 32, 66 may in certain applications of the invention be driven by a motor provided for the purpose.

A further embodiment of the invention which is shown in FIGS. 5*a* and 5*b*, wherein the same reference numerals have been used for similar parts as in FIGS. 1 and 2. In this embodiment the throttling device 14 is rotatably mounted by bearings 80, while the air-jet cleaning device 15 is stationary. The rotation of throttling device 14 can, for example, be accomplihsed by the provision of guiding means such as guiding blades 82 which impart to the main air flow 12 a rotational movement before the air flow contacts the throttling device. The rotational movement of the air flow as it enters the throttling device will impart sufficient force to the latter to obtain the rotation desired.

The ducts leading from the stationary air-jet cleaning device 15 to the outlet side of the throttling device may in this embodiment have the form of stationary ducts 84 located outside a socket 86 in which the throttling device is inserted.

The cleansing sectors and air-jet cleaning device may also be of forms and extent differing from the examples illustrated here.

In the previously discussed embodiments mention was made that the air passing through the throttling device consists of supply air. In well-designed systems the supply air is filtered so efficiently before it reaches the throttling device that air-jet cleaning of deposits on the surface of the device is hardly necessary in itself. However, it often happens that fibres and particles break away from the ducts themselves—from insulating or sound-absorbing material, for example—and this occurs in the duct system itself, that is, after the filter. Here the danger of clogging is evident unless air-jet cleaning is provided for.

The need for throttling devices to control and maintain the desired volume of air is also apparent in exhaust air ducts. Here the type of throttling member featuring fine channels or ducts as exemplified above has previously been unusable, since filters normally are not used for exhaust air. Dust suspended in indoor air rapidly deposits itself on the throttling member to such thicknesses that the latter is soon put out of operation. However, if an air-jet cleaning device of the types described above are used, throttling members may also be incorporated in exhaust air systems.

In the embodiments of FIGS. 1 and 4, the central part of the throttling member was used to unite the high and low pressure sides of the air-jet cleaning device with the main air flow before and after its passage through the throttling member, that is to say the drop in pressure over the throttling device is used to create the air jet flowing in another direction than the main air flow. Naturally, it would also be feasible for the ducts via which the air is forced into or drawn out of the air-jet cleaning device to be so designed as to take the form of by-pass ducts passing outside the throttling member. It is, however, essential that the drop in pressure occurring over the throttling device be used to create the cleansing air jet.

Although illustrative embodiments of the present invention have been described above, it is to be understood that the invention is not limited to that precise embodiment and that various changes and modifications may be effected therein by those skilled in the art without departing from the scope or spirit of this invention.

What is claimed is:

1. An apparatus for use in ventilation ducts comprising a throttling device including a body having opposite air inlet and outlet sides and a plurality of fine elongated through passages extending therebetween and producing a pressure drop for conveying air flowing from said inlet through said elongated passages to said outlet side thereof, and deflector shield means mounted adjacent said inlet side of said body to allow relative movement of said body with respect thereto while cleaning the surface of said inlet side of the body, said apparatus including means for rotating one of said body and said deflector shield means relative to the other, said shield means having an opening facing said inlet side of the body which is caused to sweep over said inlet side of the body during such relative movement and means for providing flow communication between said shield means and the lower air pressure on the outlet side of the throttling device whereby the drop of pressure across the throttling device diverts a partial air flow through said shield means in another direction than the main air flow into the body of the throttling device in order to clean the surface of said inlet side of the body and then discharges said partial air flow downstream of the body in the same direction as the main air flow.

2. Apparatus as defined in claim 1, wherein said deflector shield means comprises a pair of deflector shields respectively mounted for relative movement with respect to said inlet and outlet sides of said throttling device, one of said shields including means for diverting air flow through the passages of the throttling device in a direction opposite to that of the main air flow through the throttling device, thereby to clean said passages.

3. Apparatus as defined in claim 2, wherein said means for providing communication comprises a hollow tubular shaft rotatably mounted centrally within said throttling device, a separator wall in said tube dividing the tubular shaft into two vertical air passages, respectively communicating with said shields whereby air flows through one of said tube passages to the deflector shield adjacent said outlet side of the throttling device and is deflected back through the throttling device in a direction opposite to the main flow to the other deflector shield adjacent the inlet side of the throttling device in which the air is deflected and returned back through the other tubular passage in the direction of the main flow.

4. Apparatus as defined in claim 3, wherein said shields are mounted to rotate with the tubular shaft.

5. Apparatus as defined in claim 4, wherein said means for rotating includes an air deflector vane rigidly mounted on one of said shields in the path of the flow of air entering the throttling device, for causing rotation of the shields and tubular member.

6. Apparatus as defined in claim 1, wherein said communication means includes a duct through which air may flow from said inlet to said outlet side thereof, said shield means communicating with said duct whereby as a result of the pressure drop across the throttling device said partial air flow passes into the shield means through the passages of the throttling device whereby the shield means, through said duct, communicates with the outlet side of the throttling device.

7. Apparatus as defined in claim 1, wherein said communication means includes a duct through which air may flow from said inlet to said outlet side thereof, said shield means communicating with said duct and being slightly spaced above said inlet side of the throttling device whereby, as a result of the pressure drop across the throttling device, said partial air flow passes into the shield means through the space between the shield means and the throttling device whereby the shield means, through the duct, communicates with the outside of the throttling device.

8. Apparatus, as defined in any of of claims 1 to 7, wherein said throttling device comprises a plurality of corruguated abutting sheets wherein the corrugations in adjacent sheets cross each other at an angle whereby the partial air flow passes to the interior of the deflector shield via the passages of the body of the throttling device.

9. Apparatus as defined in claim 1 wherein said means for rotating comprises a shaft rotatably mounted to the throttling device; said deflector shield means being secured to said shaft for rotation therewith.

10. Apparatus as defined in any of claims 1, 3, 6, 7 or 9 wherein said rotating means includes a deflector vane located on the inlet side of said throttling device to deflect a portion of the main air flow into a rotating flow pattern for rotating said shield.

11. The combination comprising a ventilation duct and a throttling device rotatably mounted in said duct including a body having opposite air inlet and outlet sides and a plurality of fine elongated through passages extending therebetween and producing a pressure drop for conveying air flowing from said inlet through said elongaged passages to said outlet side thereof, and deflector shield means fixed in said duct adjacent said inlet side of said body to allow relative movment of said body with respect thereto while cleaning the surface of said inlet side of the body, and means for rotating said body, said shield means having an opening facing said inlet side of the body which is caused to sweep over said inlet side of the body during rotation of the body and means for providing flow communication between said shield means and the lower air pressure on the outlet side of the throttling device whereby the drop of pressure across the throttling device diverts a partial air flow through said shield means in another direction than the main air flow into the body of the throttling device in order to clean the surface of said inlet side of the body and then discharges said partial air flow downstream of the body in the same direction as the main air flow.

12. Apparatus as defined in claim 11 wherein said rotating means includes guiding means on the inlet side of the throttling device in the ventilation duct for imparting a rotational movement to the main air flow, which movement is transferred to the throttling device to rotate the throttling device.

* * * * *

UNITED STATES PATENT AND TRADEMARK OFFICE

CERTIFICATE OF CORRECTION

PATENT NO. : 4,296,780
DATED : October 27, 1981
INVENTOR(S) : Per Norback

It is certified that error appears in the above—identified patent and that said Letters Patent is hereby corrected as shown below:

IN THE HEADING:

Section [75] Delete "Norbach" and insert --Norback--

Signed and Sealed this

*Twentieth* Day of *April 1982*

|SEAL|

*Attest:*

GERALD J. MOSSINGHOFF

*Attesting Officer*

*Commissioner of Patents and Trademarks*